US005649438A

United States Patent [19]

Hall, Jr. et al.

[11] Patent Number: 5,649,438

[45] Date of Patent: Jul. 22, 1997

[54] METHOD AND APPARATUS FOR PNEUMATIC FORMING OF THIN FOIL MATERIALS

[75] Inventors: Herbert L. Hall, Jr., Newark; Margaret M. Woodside, Pickerington; Stanley J. Rusek, Jr., Newark, all of Ohio

[73] Assignee: Owens-Corning Fiberglas Technology, Inc., Summit, Ill.

[21] Appl. No.: 238,991

[22] Filed: Jun. 14, 1994

[51] Int. Cl.[6] ..... B21D 22/10

[52] U.S. Cl. ..... 72/60; 72/63

[58] Field of Search ..... 72/54, 60, 63

[56] References Cited

U.S. PATENT DOCUMENTS

| | | | |
|---|---|---|---|
| 2,385,083 | 9/1945 | Kemerer | 72/63 |
| 2,745,173 | 5/1956 | Janos . | |
| 3,222,902 | 12/1965 | Brejcha et al. | 72/63 |
| 4,354,369 | 10/1982 | Hamilton . | |
| 4,748,837 | 6/1988 | Kurosawa et al. | 72/63 |
| 5,090,981 | 2/1992 | Rusek, Jr. . | |
| 5,094,899 | 3/1992 | Rusek, Jr. . | |
| 5,376,424 | 12/1994 | Watanabe . | |

FOREIGN PATENT DOCUMENTS

| | | | |
|---|---|---|---|
| 1023051 | 3/1953 | France | 72/63 |
| 2342832 | 9/1977 | France . | |
| 2117950 | 10/1972 | Germany . | |
| 3151382 | 10/1982 | Germany . | |
| 80130 | 3/1990 | Japan | 72/63 |

*Primary Examiner*—David Jones

*Attorney, Agent, or Firm*—C. M. Gegenheimer; Curtis B. Brueske

[57] ABSTRACT

A method and apparatus using pneumatic pressure and reduced, controlled clamping pressure to provide reliable, high speed pneumatic forming of thin foil workpieces at ambient temperatures without lubricants or cull plates. Forming elements are provided which incorporate a combination of surfaces and features which enable the reduced, controlled net clamping pressures for forming thin foil workpieces, and control of material slip during forming. Thin foil workpieces formed therewith have reduced incidence of tearing and wrinkling of the foil material. The method is capable of fast cycle times and produces minimal waste.

23 Claims, 6 Drawing Sheets

METHOD AND APPARATUS FOR PNEUMATIC FORMING OF THIN FOIL MATERIALS

TECHNICAL FIELD

This invention relates to the forming of thin foils and, more specifically, to a method and apparatus for pneumatic forming of thin foil workpieces into simple or complex shapes at high speeds without lubricants, using reduced, controllable clamping pressures at the workpiece.

BACKGROUND OF THE INVENTION

Conventional and emerging technologies have needs for parts made of thin foil materials, particularly thin foil metal materials. It has been found that existing forming operations are unable to cost-effectively form thin foil materials into parts having desired shapes with simple and compound surfaces, and features such as wrinkle-free flanges.

For example, in the manufacture of thin foil trays suitable for use in vacuum insulation panels, such as shown in U.S. Pat. No. 2,745,173, issued May 15, 1956 to Janos, metal materials are desirable for use because of their strength and ability to seal for vacuum retention. However, this particular application requires substantially wrinkle-free flanges for vacuum tight sealing of the formed part to other parts. While thin foil materials would be desirable for reduced conductive heat leak across such insulation panels, it has been necessary to stamp thicker cold-rolled carbon steel sheet material to practice the invention of the '173 patent.

Conventional processes applied to produce thin foil metal material parts, such as trays, have limitations and drawbacks which make their use in commercial production problematic. Conventional processes include matched metal die stamping, thermoforming, hydroforming, and rubber pad forming.

For example, matched metal dies are expensive to machine, expensive to align for use, and require high clamping pressures. Insufficient clamp pressure or imperfect flatness between the two mating halves of the tool permits excessive motion of a thin foil workpiece into the forming tool, and results in a buckling mode type of failure of the foil which produces wrinkles. However, as some material draw is desirable, excessive clamping force does not solve the problem of wrinkling and further promotes tearing of thin foils during forming. In addition, matched metal dies produce shapes with non-uniform stress distribution which causes tearing in thin foils, particularly in corners. Some desirable results without wrinkling or tearing have been obtained with matched metal dies, but due to failure rates for foil materials, matched metal die processes are limited to thicker workpiece materials for economical production levels. Lubricants may be applied to enhance forming and reduce tearing of thin foil workpieces, but introduce contaminants and necessitate a post-application cleaning step, increasing production costs. However, wrinkling remains a problem even where lubricants are used.

Thermoforming of superplastic metal materials is a low pressure, high temperature process. However, foil materials are limited to conventional thermoplastic metal materials, such as certain alloys of magnesium, zinc and aluminum capable of elongation of approximately 500% or more. While lower forming pressures are enjoyed, in addition to limited material choices, higher temperatures and related die warping and energy costs, as well as increased cycle times due to heating, are additional significant drawbacks of thermoforming.

Hydroforming, by contrast, is a high pressure, standard or ambient room temperature process. However, practical considerations make difficult the hydroforming of parts having a surface area greater than about 18 inches by 18 inches. Moreover, higher failure rates, i.e. incidence of tearing and wrinkling, occur in hydroforming thin foil materials, even where the foil is sandwiched between cull plates. Cull plates are thicker pieces of steel formed along with the foil workpiece to protect it. However, the use of cull plates increases cycle time and forming pressures. As well, since the cull plates are formed along with the thin foil, they are not reusable and exact a cost penalty in production. Rubber pad forming has similar drawbacks to hydroforming, such as the need for cull plates, and higher failure rates.

Finally, because moderate to high forming pressures and clamping forces are required to form foil materials, some of these above-mentioned forming operations use elastomeric or resilient surfaces in compression with the foil workpiece. Hereafter, elastomeric or resilient surfaces will be referred to as resilient surfaces. Wherever clamping forces and forming pressures bring a foil workpiece and resilient surfaces together, air is expelled from between the two, much like during compression of a suction cup. Because thin foils are compliant, air cannot easily re-enter the tight space between the foil and the resilient surface. After the forming operation is complete, the foil is left firmly adhered to the resilient surface. The foil is often damaged during the process of its removal, and may require manual removal. This occurs whether large surface areas or annular or peripheral areas of the foil materials are compressed against the resilient surface.

Again, conventional forming operations such as hydroforming and rubber pad forming overcome these further difficulties by sandwiching the thin foil between cull plates which can withstand the peel back force typically encountered with rubber diaphragms and pads. However, as noted, these activities increase cycle time and production costs.

Accordingly, improvements in forming thin foil sheet materials are needed to produce more cost effective shapes and products using thin foil materials.

SUMMARY OF THE INVENTION

The present invention satisfies that need with a method and apparatus which use pneumatic pressure and reduced, controlled clamping pressure to provide reliable, high speed pneumatic forming of thin foil workpieces at ambient temperatures without lubricants or cull plates. Forming elements are provided which incorporate a combination of surfaces and features which enable reduced, controlled net clamping pressures to form thin foil workpieces, and allow for control over material slip during forming. Thin foil workpieces formed therewith have reduced incidence of tearing and wrinkling of foil material. The method and apparatus are capable of fast cycle times and produce minimal waste.

In accordance with the present invention, the method for pneumatic forming of thin foil workpieces at ambient temperatures begins by positioning a thin foil workpiece between a first and a second forming element. The first forming element has a first resilient surface, and the second forming element has at least one forming cavity and a second clamping surface therearound. The first and second forming elements are then moved into clamping relationship with the thin foil workpiece. The first resilient surface of the first forming element contacts a first surface of the thin foil workpiece, while the second clamping surface of the second forming element contacts the opposing second surface of the thin foil workpiece.

The area of the first surface of the thin foil workpiece in contact with the first resilient surface is referred to as the first contact area. Upon application of clamping force to the forming elements, the first resilient surface applies clamping pressure to the first contact area, and its compression against the first contact area produces a seal around a volume existing between the thin foil workpiece and the first forming element.

The thin foil workpiece is then substantially formed into the forming cavity by supplying pneumatic pressure to the volume. However, in accordance with the present invention, development of full clamping force is not a prerequisite to application of pneumatic pressure for forming. Rather, once clamping force is initially applied to the forming elements to hold the workpiece in place, pneumatic pressure is provided to the sealed volume to expand the workpiece into shape against the forming cavity surfaces. In so doing, the workpiece is formed with generally uniform stress distribution by an overall pneumatic pressure which is reduced in the present invention due to the elimination of cull plates.

The result of these two opposing forces (clamping force and pneumatic force) establishes a net clamping pressure upon the first contact area. Control over net clamping pressure in accordance with the present invention is obtained by slightly lagging the pneumatic pressurization rate of the volume behind the clamping rate characteristic of the press or other conventional device which applies the clamping force. Every such press or device requires a finite time to develop full clamping force, and the rate of development of clamping force is referred to as the clamping rate. Variation in the pressurization rate and clamping rate permit one to control the net clamping force at the first contact area which, in turn, controls the ability of the thin foil workpiece material to slip during forming. Pressurization of the volume may follow immediately or shortly after the clamping pressure is initiated, but before the full clamping pressure is developed. It is always imperative, however, that at the beginning and during a forming cycle, a minimum net clamping force is maintained by the first resilient surface on the first contact area which is high enough to seal the pneumatic pressure into the volume.

As a result of applying pneumatic pressure to the volume during development of the clamping pressure, net clamping pressure is reduced during forming. This reduction of clamping pressure allows controlled and accurate slip of the foil material into or toward the forming cavity during forming. Rather than being at or near full clamping force at the outset of forming, excessive clamping forces for a particular material and application may be avoided, and necessary slip of foil material into or towards the forming cavity to produce the desired result is possible.

One illustration of the benefit of such control is that near the completion of the forming cycle, the net clamping pressure may be controlled to a generally minimal pressure, while the pneumatic pressure is near maximum pressure. Final forming of a thin foil workpiece into certain shapes may thus proceed with minimal net clamping pressure thereon. This enables the material to slip as needed (particularly in final forming) to achieve tighter radii, such as are present in corner and edge portions of a thin foil workpiece, and to achieve deeper shapes.

At the end of the step of forming, if the pneumatic pressure of forming is further increased, net clamping force can become so low that the gas begins to leak out of the volume across a portion of the first contact area. This leakage may be detected by sensors, such as a pressure or acoustic sensor, to signal completion of the forming step. Regardless, thereafter, the method ends by removing the thin foil workpiece in formed condition from between the first and second forming elements.

In accordance with the present invention, at the end of the forming cycle, flange areas will remain substantially wrinkle-free, because buckling forces developed during forming were further resisted by the first resilient surface.

Thus, the first resilient surface simultaneously controls foil material slip, seals the forming pressure into the volume, and provides a surface which prevents buckling failure of the thin foil workpiece.

In addition to producing superior shapes having wrinkle-free flanges, the method and apparatus of the present invention have further advantages. The present invention requires no lubricants to form thin foil materials, and thus does not expose parts to surface contaminants which might hinder further assembly (e.g. welding), limit potential uses of the method or apparatus, or require removal or cleaning after forming. As well, the first resilient surface provides several important operational and cost advantages over matched metal dies, and other alternative forming operations which result in significant cost savings. First, the resilient surface allows the first and second forming elements to be self-correcting for slight irregularities or deviations in planarity in the second clamping surface which would result in critical pressure loss from matched metal dies. Second, misalignment of the first and second forming elements, so critical to avoid damage and wear on matched metal dies, is greatly relaxed particularly where the first resilient surface is a resilient sheet. Such a sheet is amenable to clamping a workpiece even if the first and second forming elements are slightly misaligned. Thus, lower cost tooling may be used, and expensive alignment costs are reduced in accordance with the present invention. Finally, it has been found that the present invention enables the use of higher pneumatic pressures for thin foil forming than are available using conventional alternative pneumatic operations, such as thermoforming where high temperatures prohibit use of resilient seals. In addition, larger shapes can be formed in accordance with the present invention than can be achieved with some alternative methods, such as hydroforming.

These and other features and advantages of the present invention, such as novel clamping surface features, air bearings and part release methods, are disclosed in the drawings and detailed description which follow.

DETAILED DESCRIPTION OF THE PREFERRED EMBODIMENTS

The method and apparatus 10 of the present invention use pneumatic pressure and reduced, controlled net clamping pressure for reliable high speed forming of thin foil workpieces 12 without lubricants or cull plates, producing formed thin foil parts with reduced incidence of tearing and wrinkling, as representatively shown in FIGS. 1A through 4.

Figure 1A:
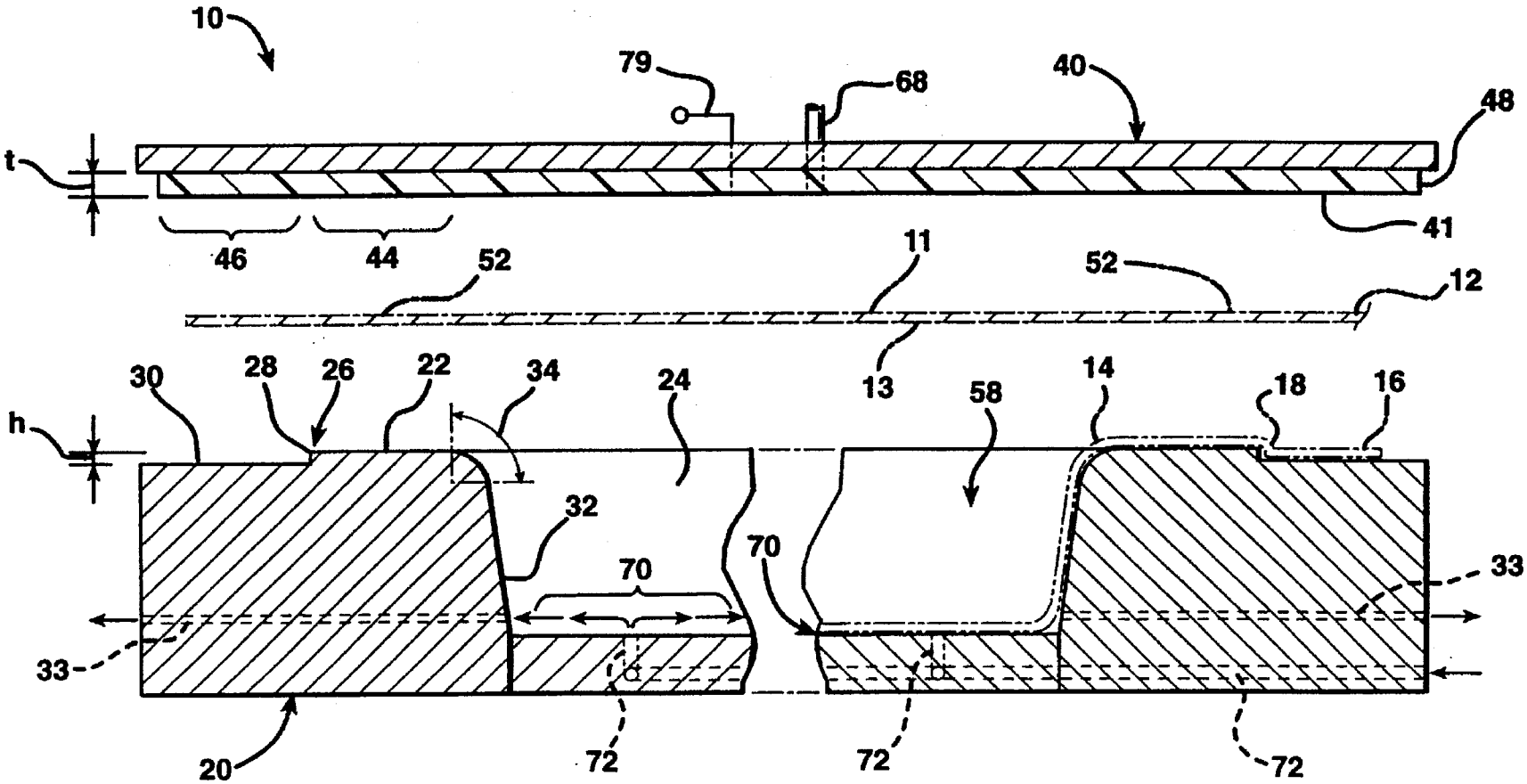
FIG. 1A is a schematic view in cross-section of the preferred embodiment of the present invention, with a representative forming cavity.

Referring to FIG. 1A, in accordance with the present invention, the method for pneumatic forming of thin foil workpieces 12 at ambient temperatures begins by positioning a thin foil workpiece 12 between a first and a second forming element 40, 20. The first forming element 40 has a first resilient surface, and the second forming element 20 has at least one forming cavity 24, preferably bounded by a second clamping surface 22. The first and second forming elements 40, 20 are then moved into clamping relationship with the thin foil workpiece 12, as further shown in FIG. 1B. The first resilient surface of the first forming element 40 contacts a first surface 11 of the thin foil workpiece 12, while the second clamping surface 22 of the second forming element 20 contacts the opposing second surface 13 of the thin foil workpiece 12.

Figure 1B:
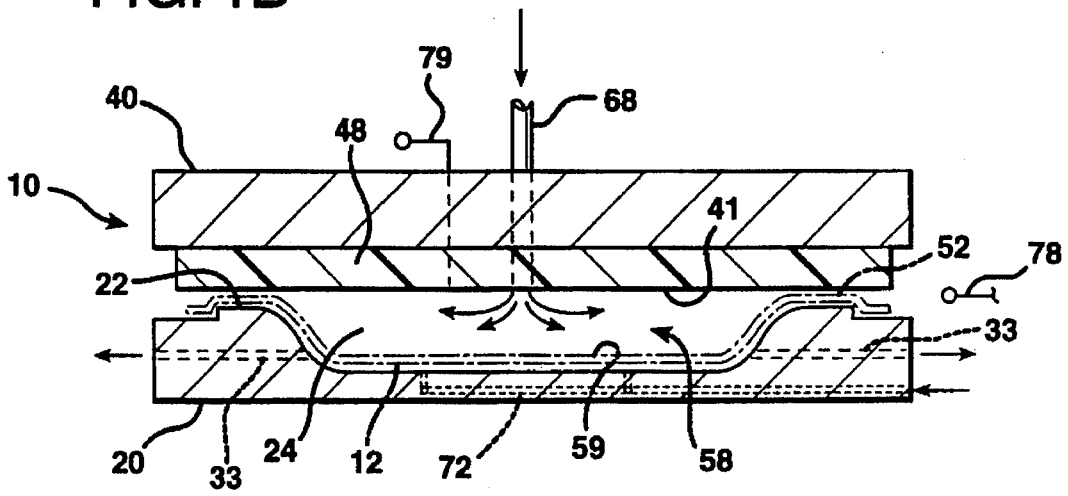
FIG. 1B is a schematic view in cross-section of the preferred embodiment of FIG. 1A with the workpiece nearing completion of the forming process.
Figure 1C:
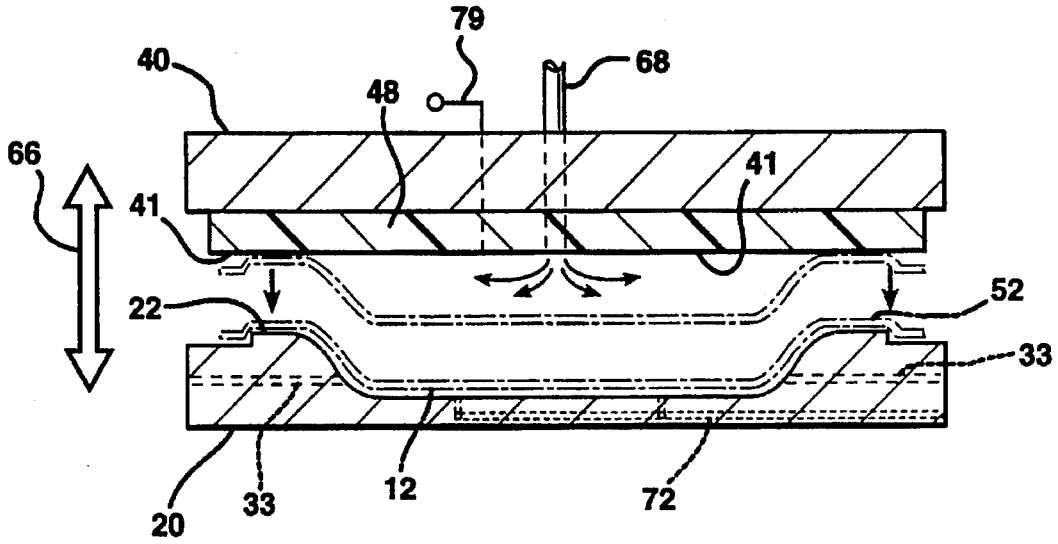
FIG. 1C is a schematic view in cross-section of the preferred embodiment of FIG. 1B releasing the workpiece.

Referring to FIGS. 1A–1B, the area of the first surface 11 of the thin foil workpiece 12 in contact with the resilient surface 41 is referred to as the first contact area 52. Upon application of clamping force to the forming elements 40, 20, the first resilient surface 41 applies clamping pressure to the first contact area 52, and its compression against the first contact area 52 produces a seal around a volume 58 existing between the thin foil workpiece and the first forming element, as best shown in FIG. 1B.

Figure 4:
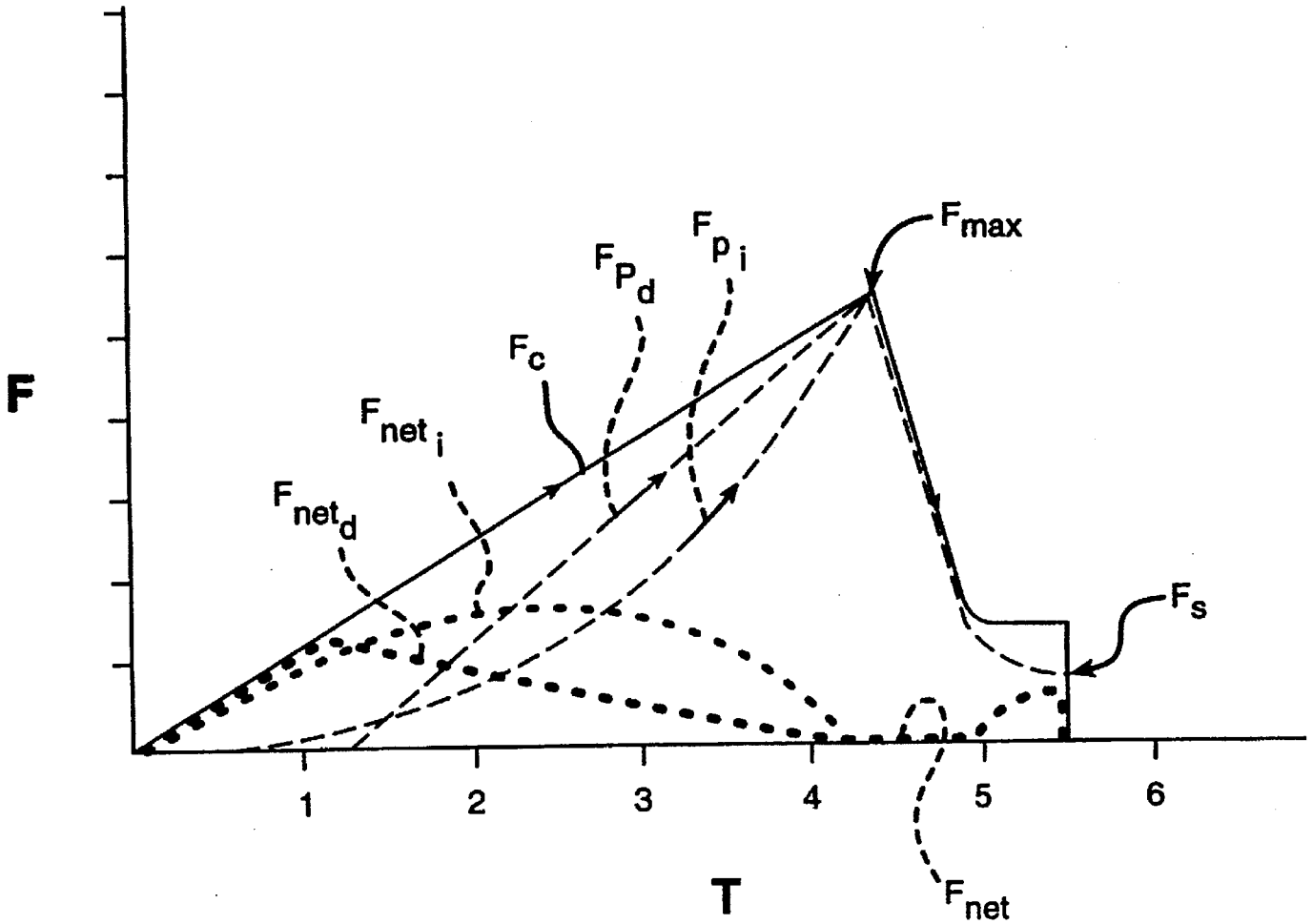
FIG. 4 is a representative graph of the clamping force, pneumatic force and net clamping force applied over time during forming of a thin foil workpiece.

Referring to FIG. 1B, the thin foil workpiece 12 is then substantially formed into the forming cavity 24 by supplying pneumatic pressure to the volume 58. However, in accordance with the present invention, development of full clamping force is not a prerequisite to application of pneumatic pressure for forming. Rather, as shown in FIG. 4, once clamping force, $F_c$, is initially applied to the forming elements 40, 20 to hold the workpiece 12 in place, pneumatic pressure, $F_P$, is supplied to the sealed volume 58 to expand and shape the workpiece 12 against the surfaces of the forming cavity 24. Forming is accomplished in accordance with the present invention by generally contemporaneously increasing both the clamping pressure holding the thin foil workpiece 12 and the pneumatic pressure forming the workpiece 12, as may be understood from FIG. 4.

Figure 6:
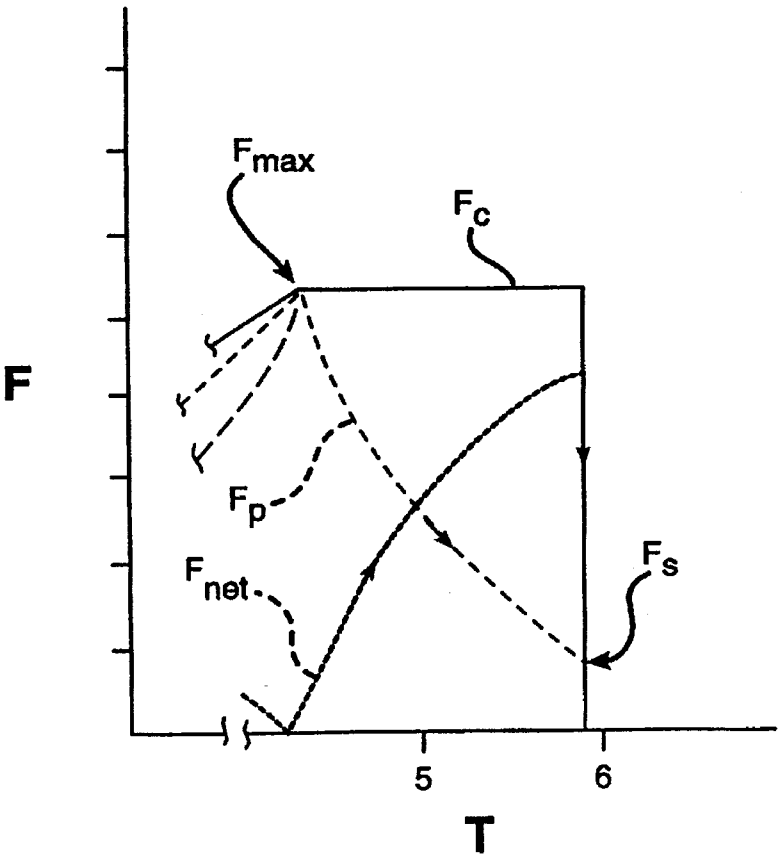
FIGS. 5 and 6 are representative graphs of the clamping force, pneumatic force and net clamping force over time after forming of a thin foil workpiece for alternative methods of release.
Figure 5:
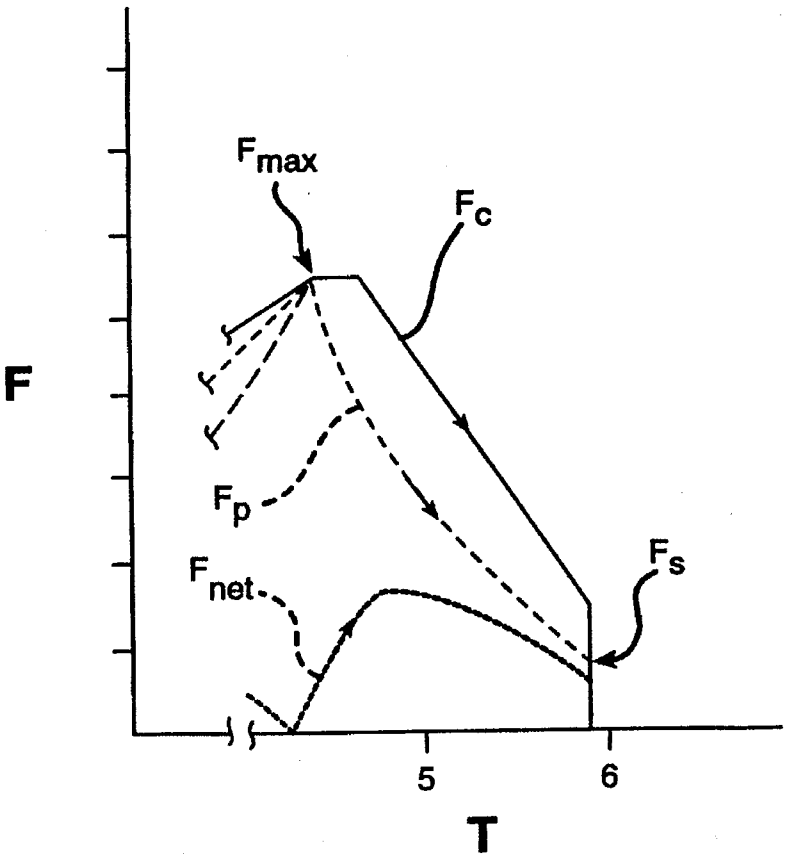

Still referring to FIG. 4, the pneumatic force, $F_p$, is indicated by the dashed lines, while the clamping force, $F_c$, is indicated by the solid line. The vertical scale is simply a relative scale of force, while the horizontal scale, T, represents time in seconds. The point, $F_{max}$ represents full clamping force, and full pressure force, which may counterbalance to yield a zero net clamping force, denoted $F_{net}$, and indicated by a dotted line. $F_{net}$ may decline to zero, or may stop short of zero. FIGS. 4–6 further show alternatives for release of the formed part. In each case, forces are reduced so that a pneumatic force level $F_s$ is achieved which accommodates the needs of a "shock release" method of part removal further disclosed below. All forces are representatively shown, and the present invention is not limited to devices evidencing only the exemplary curves shown. The clamping rate is typically constant in conventional devices (as shown), however, hydraulically controlled devices have the capability to provide variable clamping rates. Pneumatic pressure can likewise be controlled by valves to effect the pressurization rate.

The result of these two opposing forces (clamping force and pneumatic force) establishes a net clamping force, $F_{net}$, and net clamping pressure upon the first contact area 52, also illustrated in FIG. 4. Control over net clamping pressure in accordance with the present invention is obtained by slightly lagging the pneumatic pressurization rate of the volume 58 behind the clamping rate characteristic of the press or other conventional device which applies the clamping force. Conventional devices are, for example, hydraulic or mechanical presses, preferably having hydraulic tonnage control. Every such press or device requires a finite time to develop full clamping force, and the rate of development of clamping force is referred to as the clamping rate. Variation in the pneumatic pressurization rate and clamping rate permit one to control the net clamping force, $F_{net}$, at the first contact area 52 which, in turn, controls the ability of the thin foil workpiece material to slip during forming. Pressurization of the volume 58 may follow immediately or shortly after the clamping pressure is initiated, but before the full clamping pressure is developed, as shown in FIG. 4. It is always imperative, however, that at the beginning and during a forming cycle, a minimum net clamping force is maintained by the first resilient surface 41 on the first contact area 52 which is high enough to seal the pneumatic pressure into the volume 58.

In FIG. 4, line $F_{Pi}$ represents the case where pneumatic pressure is applied instantaneously after initial clamping force is applied. Line $F_{Pd}$ represents the case where pneumatic pressure is delayed and applied a short time (e.g. 1.2 sec) after the initial clamping force is applied.

As a result of pressurization of the volume 58 for forming during development of the clamping pressure, net clamping pressure is reduced during forming, and limited slip of the foil material into or toward the forming cavity 24 during forming is controllable. Rather than being at or near full clamping force at the outset of forming, excessive clamping forces for a particular material and application may be avoided, and necessary slip of foil material into or towards the forming cavity 24 to produce the desired result is possible.

Control over the net clamping pressure in accordance with the present invention, enables one to avoid either too little clamping force which would cause excess workpiece movement and wrinkling, or excessive clamping force which would inhibit forming for a particular material and application. Rather, such slip in foil material as is desirable during deformation into the forming cavity 24 is possible, along with necessary clamping pressure to inhibit wrinkling. Such control over the net clamping pressure is exerted by varying either the increase in clamping pressure or the increase in pneumatic pressure, or both, as they are being performed contemporaneously.

If the thin foil workpiece 12 is perforated for any reason, the perforations must be located in regions of the workpiece which are not subjected to the highest tensile stresses during the forming cycle to avoid propagating tears in the foil material. That is, typically perforations should be in the central flat areas of the workpiece 12. Gas must be prevented from escaping these perforations during forming by means of tapes or other sealing means (not shown) which will maintain pneumatic pressure in the volume 58 needed for forming.

Pneumatic pressure is supplied between the first surface 11 of the thin foil workpiece 12 and the first forming element 40 through a first gas supply way 68 connected to a conventional source (not shown) of pneumatic pressure greater than ambient pressure. A first gas supply way 68 is shown positioned to supply gas at a point inward from the periphery of the first contact area 52, as representatively shown in FIGS. 1A–1C, and may be used both for forming and venting pneumatic pressure when necessary. Any conventional working gas such as air, nitrogen or the like may be used. Air between the second surface 13 of the thin foil workpiece 12 may be vented during forming through forming vents 33 in the second forming element 20. It is noted that forming cavity 24 could be one of a plurality of cavities 24 into which a workpiece 12 is formed, and each cavity would preferably include forming vents 33.

Near the completion of the forming step, the net clamping pressure is preferably established at a generally minimal pressure, while the pneumatic pressure is at a generally maximum pressure to complete forming. Further deforming of final portions of the thin foil workpiece 12 may thus proceed, which is advantageous for material slip desired during final forming of corner portions of a workpiece.

Finally, at the end of the step of forming, if the pneumatic pressure of forming is further increased, net clamping force can become so low that the gas begins to leak across a portion of the first contact area 52. This leakage may be detected by a sensor 78, shown in FIG. 1B, such as a pressure or acoustic sensor, to signal completion of the forming step. Taking this a step further, rapid venting of volume 58 past the foil workpiece's flange also acts as a pressure relief valve against overpressurization. Alternatively, depressurization can be achieved using a pressure sensor 79 connected to read pressure in volume 58, such as a pressure transducer or pressure switch, preset to detect a high pressure level. Sensor 79 is connected (not shown) to close a gas supply valve (not shown) connected to supply pneumatic pressure through first gas supply way 68, and to further vent pressure through the first gas supply way 68.

However, it is not mandatory that a high pressure bleed or leakage of gas be established across the flange 16 at the end of the forming cycle. High quality formed foil parts 14 may be formed without this feature. And, where the leaking gas causes a workpiece flange 16 to flutter or oscillate, undesirable work hardening can take place, damaging the affected portion of the flange 16 with brittleness, fatigue or tearing.

The method ends by removing the thin foil workpiece 12 in formed condition from between the first and second forming elements 40, 20.

In accordance with the present invention, in addition to providing sufficient clamping pressure to prevent wrinkling in flanges, control of net clamping pressure is desired to avoid tearing, and to permit rapid, cost-effective forming of thin foils. As discussed above, control over the rate and amount of movement of thin foil material into or towards the forming cavity 24 allows more complete forming of shapes, assures forming of tighter radii in curves and corners, and allows for formation of deeper shapes. This slip or movement, however, is inhibited by frictional contact between the thin foil workpiece 12 and the surfaces of the forming cavity 24 as the foil material approaches its desired shape near the completion of the forming process.

Accordingly, two additional features, polished surfaces and an air bearing 70, separately or in combination, are provided to reduce friction and facilitate complete forming of radii and shapes.

Referring to FIG. 1A, polished or highly machined surfaces may be provided at several possible locations. First, polished surfaces may be provided in the transition area 34 and/or all or part of the cavity face 32 extending from the second clamping surface 22 towards the bottom of the forming cavity 24. Second, additional polished surfaces may be provided along the bottom of the forming cavity 24 extending towards the cavity face 32 or transition area 34 to permit foil material movement.

Referring to FIGS. 1A and 1B, alternatively, or in combination with one or more of the polished surfaces, an air bearing 70 is preferably provided along the bottom of the forming cavity 24 to enhance formation of the thin foil workpiece 12 into corners, enable formation of tighter radii and deeper shapes than otherwise possible without the air bearing 70.

Provision of an air bearing 70 in accordance with the present invention includes supplying pneumatic pressure between the second surface 13 of the thin foil workpiece 12 and the forming cavity 24 of the second forming element 20. At least one and, preferably, a plurality of second gas supply ways 72 provide gas to the cavity 24 at positions, spaced from the center of the forming cavity 24, as shown in the representative cavity 24 of FIGS. 1A–1C. The second gas supply ways 72 are spaced from the center so that gas flow therefrom remains freer as forming is completed. If the second gas supply ways 72 are positioned to supply gas centrally along the bottom of the cavity 24, forming of the central portion of the workpiece 12 would tend to inhibit gas flow when needed at the end of the forming cycle to assist in forming corners and edges. The pneumatic pressure from second gas supply way 72 vents through forming vents 33 near the edges, corners or sides of the forming cavity 24, so that an air bearing 70 thus forms between the thin foil workpiece 12 and the bottom of the forming cavity 24. This air bearing 70 reduces friction during deformation of the thin foil workpiece 12 into the forming cavity 24.

As the air bearing 70 is particularly beneficial during final forming, production of the air bearing 70 may be delayed until the step of forming nears completion. That is, just prior to reaching maximum forming pressure, the gas supply to the volume 58 is diverted to the second gas supply ways 72 located in the bottom of the second forming element 20. Equal pressure above and below the thin foil material 12 allows it to "float" thereby reducing the frictional force that tends to impede further movement along the cavity bottom and into the corners and edges of the forming cavity 24. Polished interior surfaces of the second forming element 20 can have a similar beneficial effect, but to a slightly lesser extent.

Although the gas supply is not shown, and may be variously configured, it is understood that to quickly charge the volume 58 to levels of 600 psi, for example, the supply pressure must be higher than this value. Otherwise, long cycle times result.

Figure 3A:
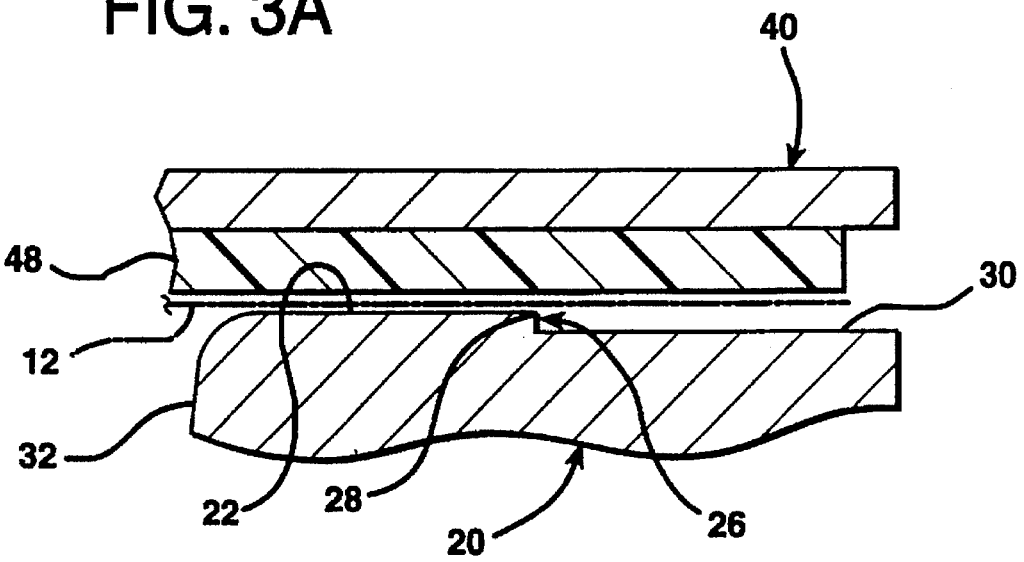
FIGS. 3A and 3B are detail views showing the bending a representative foil material in accordance with the present invention.
Figure 3B:
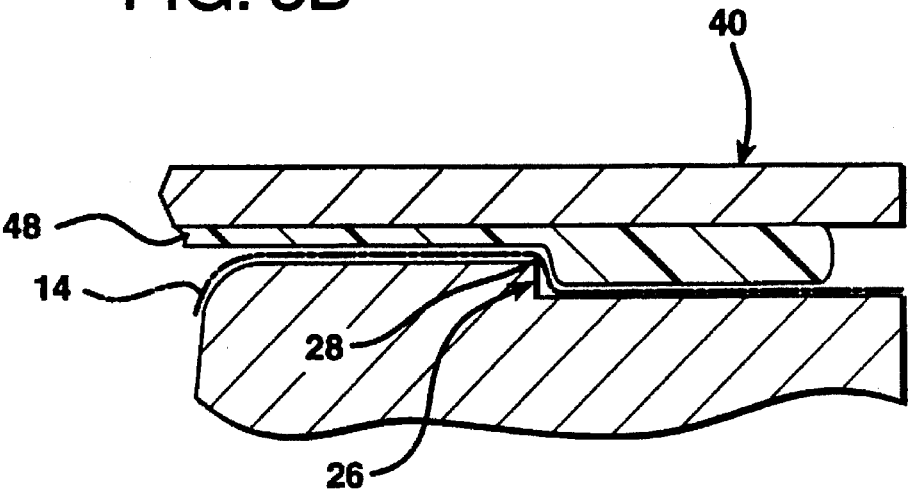

The present invention includes not only a means for controlling the net clamping pressure exerted on a thin foil workpiece 12, but in a further aspect of the present invention, provides a further feature and method for actually reducing the initial and subsequent amounts of clamping force necessary for foil retention. Referring to FIGS. 1A and 3A–3B, in accordance with this further aspect of the present invention, the second forming element 20 includes a retaining step 26 defining the outer boundary of the second clamping surface 22. The retaining step 26 has an edge 28 over which the thin foil workpiece 12 is bendable. In accordance with the method as shown best in FIGS. 3A–3B, the thin foil workpiece 12 is positioned generally beyond the outer boundary of the second clamping surface 22, i.e. extending over the step 26. Increasing the clamping pressure compresses portions 44 (see FIG. 1A) of the first resilient surface 41, and causes portions 18 (see FIG. 1A) of the thin foil workpiece 12 to bend over the edge 28 of the step 26. The portions 18 so bent reduce the net clamping pressure needed to retain the thin foil workpiece 12 against slippage during forming, by engaging against the retaining step 26 and resisting lateral movement, at the periphery of the thin foil workpiece 12. Thus, reduced clamping force between the first and second forming elements 40, 20, and reduced clamping pressure at the first contact area 52 is required to hold the thin foil workpiece 12 against gross lateral movement during forming.

In practicing this aspect of the invention, it is preferred that the retaining step 26 extend downward from the second clamping surface 22 and form a generally sharp edge 28 therewith over which a foil workpiece is bendable. Preferably, the steps of compressing portions 44 of the first resilient clamping surface 41, and bending portions 18 of the thin foil workpiece 12 are performed simultaneously. Alternatively, the forming step 26 may be a narrow projection (not shown) or surface indentation (not shown) presenting an edge 28 over which the thin foil workpiece may be bent. While these alternatives are viable, they have various drawbacks including higher cost, shorter forming element life, and lowered effectiveness.

Referring now to FIG. 1A, to further provide a limit to the clamping force and increases in the clamping force, and to protect the first resilient surface 41 from overpressurization, the second forming element 20 may optionally further include a land area 30 adjoining the retaining step 26 and extending outward therefrom in generally opposing relationship to portions 46 of the first resilient surface 41. The land area 30 functions to spread the applied clamping force, and reduce increases therein as the first resilient surface 41 becomes increasingly compressed as shown in FIGS. 3A–3B. Thus, the step of increasing clamping pressure may further include spreading the clamping force over a larger surface area including the second clamping surface 22 and the land area 30.

Preferably the land area 30 is positioned further from the first forming element 40 than is the second clamping surface 22 as described and shown in FIGS. 1A–1C and 3A–3B. Alternative embodiments are within the scope of the present invention, and include, by way of example, providing the land area 30 on the same plane or raised closer to the first forming element 40 than the clamping surface 22. Corresponding thereto, the first resilient surface may be shaped to include an indented portion (not shown) in opposing relation with the raised land area 30. The raised land area 30 and indented portion of the first resilient surface could also receive and spread higher clamping forces over the land area 30 to prevent overpressurization of the first resilient surface in like fashion with the preferred embodiment. However, this configuration is not preferred as it requires additional material costs, such as machining the resilient surface, and introduces the need for more precise, more costly alignment between the first and second forming elements 40, 20. Further, unlike the preferred embodiment wherein the first resilient surface 41 requires less precise alignment and can be shifted to spread wear and avoid compression set, the alignment required in the alternative embodiment will cause the first resilient surface to have a shorter useful service life by providing repeated compression at the same places on the resilient surface 41.

These and further aspects of the retaining step 26, land area 30, and reduced clamping force related thereto are further discussed in commonly assigned, copending related application, U.S. patent application Ser. No. 08/239,158, filed May 6, 1994, entitled Apparatus and Method for Retention of Thin Foils During Forming, by Hall, et al. now U.S. Pat. No. 5,505,071 which is incorporated herein by reference.

Once the thin foil workpiece 12 is formed, there remains the problem of its removal from the first and second forming elements 40, 20, and in particular, from the first resilient surface 41. In a still further aspect of the present invention, removing the thin foil workpiece 12 in formed condition includes a rapid release method, referred to herein as "shock release". The method includes maintaining a pneumatic pressure, $F_s$, (see FIGS. 4–6) greater than ambient pressure in the volume 58 between the first surface 11 of the workpiece 12 and the first forming element 40, inward from the periphery of the contact area 52 while the thin foil workpiece 12 remains in compression (indicated by $F_{net}$). This pressure is preferably residual pressure after bleed-down of pneumatic pressures used in forming, but may also be supplied or supplemented from a source (not shown) of pneumatic pressure. It is preferred in practicing the present invention to maintain, or alternately, supply pneumatic pressure in the range from about 1.7 bar (25 pounds per square inch absolute [psia]) to about 8 bar (115 psia). Higher pressures are possible, but when overpressure occurs, the impact of release can damage the formed part 14 and provide a personnel hazard.

As shown in FIGS. 4–6, alternative methods of relieving clamping force and pressure force may be practiced to establish the conditions for shock release of the formed part 14. The method shown in FIG. 4 is preferred. As shown, the clamping force $F_c$ and pneumatic force $F_P$ are relieved simultaneously across the flange surfaces 16 for rapid pressure reduction, and pneumatic force is also relieved through first gas supply way 68. At a predetermined level, relief of the clamping force is discontinued, allowing minimum clamping force to reestablish on the formed part as pneumatic pressure continues to decline by bleeding out through first gas supply way 68. Once a predetermined pneumatic pressure level (indicated at $F_s$) is achieved in the volume 58, the second forming element 20 is moved out of contact with the formed part, initiating shock release of the formed part.

FIGS. 5 and 6 show alternative methods of reaching the predetermined pneumatic pressure level indicated at $F_s$. In FIG. 5 the pneumatic pressure as shown is relieved only through the first gas supply way 68. The rate of pressure drop in $F_P$ is slower, and the reduction in clamping force $F_c$ lags and generally tracks that rate to maintain minimum clamping force. Because this method is slower it is not preferred for commercial applications. In FIG. 6 the pneumatic pressure is again relieved only through the first gas supply way 68, as in FIG. 5. In the method of FIG. 6, however, the clamping force remains at the maximum force $F_{max}$, which causes the net clamping force to increase dramatically. Because this method is slower and introduces high net clamping forces which increase wear on the first resilient surface, this method is also not preferred.

Regardless, thereafter, the method of the present invention calls for separating the second forming element 20 from contact with the thin foil workpiece 12, rapidly releasing the thin foil workpiece 12 from the first resilient surface 41 with pneumatic pressure in volume 58. Suitable part release is provided with sudden and immediate separation from the resilient surface, and without damage to the part.

These and further aspects of the shock release of formed parts are further discussed in commonly assigned, copending related application, U.S. patent application Ser. No. 08/610,173, filed Mar. 4, 1996, entitled Method and Apparatus for Shock Release of Thin Foil Materials, by Hall, which is incorporated herein by reference.

Many factors can affect the clamping force and clamping pressure required to prevent the incidence of wrinkles in the flange 16 of a thin foil workpiece: surface finish of the tool; forming depth; overall forming tool dimension; flange width; step height, h, first resilient surface (seal) material type and thickness, t; and others. In practice, it is preferred that net clamping pressure control is determined empirically for any given set-up by trial and error adjustment of the pneumatic pressurization rate at the maximum value which yields the shortest cycle time while inhibiting wrinkle formation.

It is understood from the above description that as pneumatic pressure increases in the volume 58 during forming, so must the clamping force. The key to short forming cycle times is to neither incur excessively low or excessively high clamping pressures. Excessively high clamping pressures can result in no foil movement, which restricts forming depth, limits the types of metals which can be easily formed, effects the rate of forming, shortens the life of the elastomer seal, and greatly increases the probability of foil rupture for operations involving maximum forming depth. In the example below, proper control of clamp pressure during the pressurization cycle allows a permissible foil movement of approximately 0.05 cm (0.020 in) to 0.20 cm (0.080 in) while preventing the formation of wrinkles. This range will vary depending on the particular application.

To illustrate the principles and practice of the present invention, the following example is set forth, however, there is no intent to limit the present invention thereto.

EXAMPLE

One proposed application for the present invention has been to form pan-shaped parts from thin foil materials for use in a vacuum insulation panel. Use of thin foil materials in such shapes present manufacturing problems with conventional methods and apparatuses which are overcome by the present invention. As a result, thin foil material thicknesses may be used cost-effectively to further reduce thermal conduction between cold and warm sides of the panel. In addition to foil thickness, low thermal conductivity is enhanced by material selection. Stainless steel foil materials are preferably used for their low thermal conductivity and other significant properties for vacuum related applications, including corrosion resistance, strength, weldability, and tolerance to bake-out procedures during manufacturing. However, a wider range of materials are available than are set forth in this example, and in general, than may be used in other processes, such as thermoforming.

Figure 2:
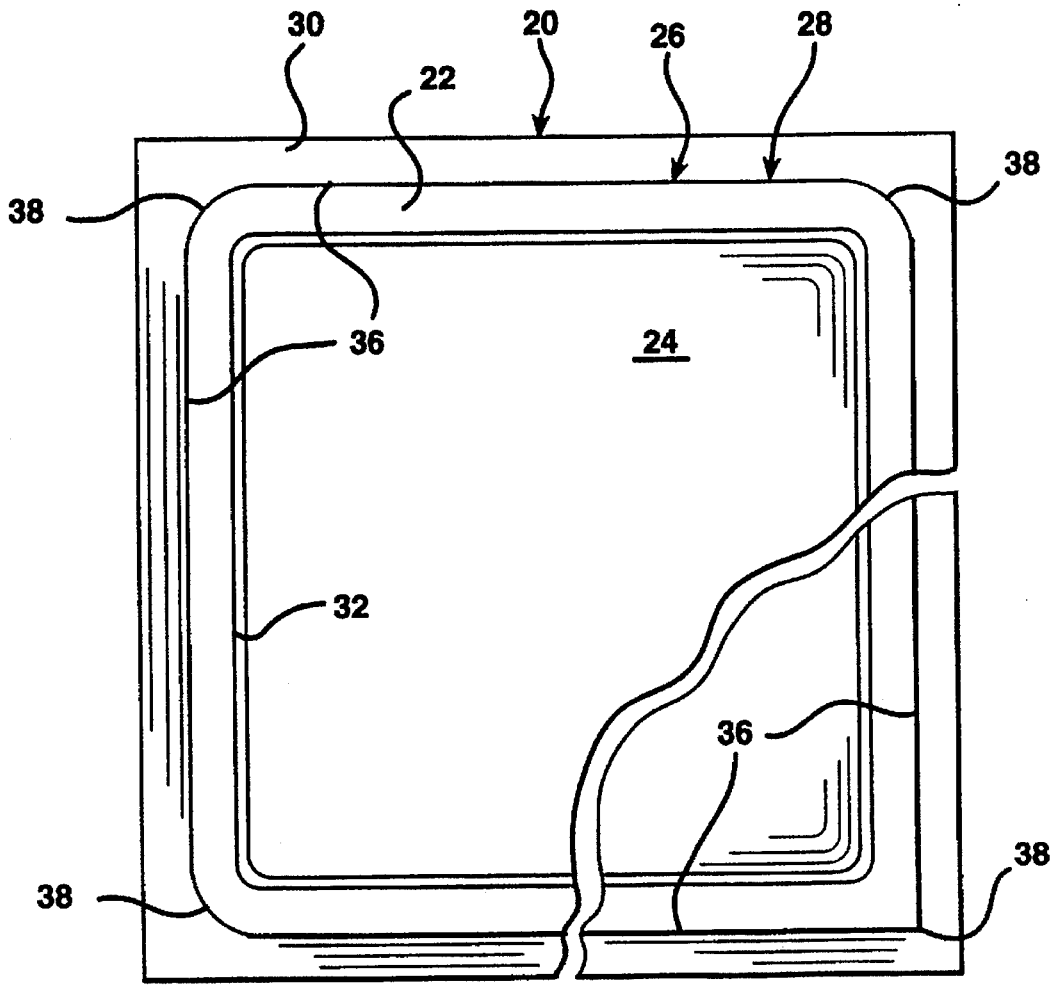
FIG. 2 is a schematic plan view of the second forming element in the preferred embodiment of the present invention shown in FIG. 1A.

In this illustrative example, pans were formed of 201 and 304 stainless steel foil material less than 0.0254 cm (0.010 in) thick, and in a preferred range of 0.0051 cm (0.002 in) to 0.0127 cm (0.005 in) in thickness. Thin foil workpieces 12 of 0.0076 cm (0.003 in) thickness have been repeatedly formed in accordance with the present invention. An open tray or pan shape approximately 26.7 cm (10.5 in) square having flanges 16 was formed in first and second forming elements 40, 20, as shown in FIGS. 1A–3B. The first resilient surface 41 was made of a sheet 48 of elastomer, to wit, polyurethane, from the preferred range of hardness of approximately 70–90 durometer, Shore A, and thickness of approximately 0.15 cm (0.06 in) to 1.27 cm (0.50 in). Preferred is polyurethane of 85 durometer, Shore A, tensile strength grade 520 bar (7500 psi), and having a thickness, t, of 0.3175 cm (0.125 in). Where a resilient material or an elastomer of this preferred size is used, the retaining step 26 is preferably in the range of 0.0762 cm (0.03 in) to 0.127 cm (0.05 in) high. The retaining step height, h, was 0.1016 cm (0.040 in) high, which was large relative to the foil thickness (0.0076 cm). As seen in FIG. 2, the retaining step 26 had generally straight sides 36 and curved corners 38 having a radius of approximately 3.3 cm (1.30 in). The forming cavity 24 further included a transition surface 34 having a radius of 0.38 cm (0.15 in) between the second clamping surface 22 and the face 32 of the forming cavity 24. The face 32 of the forming cavity 24 is positioned at approximately 10 degrees from vertical, widening towards the open end of the forming cavity 24 for easier removal of the formed part 14 after forming.

For the thin foil workpiece 12, the minimum clamping pressure is on the order of 14 bar (200 pounds per square in [psi]) in combination with a second clamping surface 22 and land area 30 of 0.95 cm (0.375 in) wide having a step 26. Referring to FIG. 2, the distance across the forming cavity 24 from step 26 to step 26 (left to right, or up and down as seen by the reader) is 46 cm (18 in) by 46 cm (18 in). The area of the clamping surface 22 plus land area 30 is approximately 170 $cm^2$ (26.4 $in^2$). The initial pneumatic pressure is about 3.4 bar (50 psi), while the initial clamping pressure is about 14 bar (200 psi).

During initial stages of forming in accordance with the present invention, relatively small pneumatic forming pressures on the first surface 11 of the thin foil workpiece 12 can exert significant tensile hoop stress within the foil. If excessive movement of the foil material into or toward the interior of the forming cavity 24 is permitted, the foil in the flange 16 area of the workpiece 12 will fail in compression by buckling up into the first resilient surface 41 and form wrinkles. The minimum clamping pressure (between the first resilient surface 41 and the first contact area 52 of the workpiece 12 [where the flange 16 is formed]) is on the order of 14 bar (200 psi) for 0.076 cm (0.003 in) thick fully annealed 304 stainless steel foil.

In accordance with this example, pneumatic forming of the thin foil workpieces 12 resulted in high quality pan shapes having wrinkle-free flanges. In addition to the advantages noted above, the pan shape formed in accordance with the present invention includes thinning of the material along the pan sides, and near corners. Presence of this thinner material in the pan sides further reduces conductive heat leak between warm and cold faces of the vacuum panel when applied to its intended use as thermal insulation.

As may be appreciated, the present invention thus achieves rapid cycle times with reduced clamping pressures, greater control over forming process pressures and material slip, and high quality part production without waste. Conventional cull plates which result in waste, lubricants which require additional cleaning steps, and conventional workpiece removal techniques which can result in damage to formed parts, are all avoided. Less stringent alignment and less costly forming element criteria may be enjoyed in accordance with the present invention, while higher quality, more reliable production of thin foil parts is achieved.

The method and apparatus 10 of the present invention are preferably performed with thin foil workpieces 12 having a thickness less than approximately 0.025 centimeters (cm) (0.01 inches). Forming of such thin foil workpieces 12 may be achieved in less than about six seconds in accordance with the present method and apparatus 10. The teachings of the method and apparatus 10 may be equally applied to the forming of thin foil workpieces 12 into single or multiple forming cavities 24, and has the capability of being applied to form much larger workpiece surface areas than conventional methods when applied to thin foil workpieces 12, particularly the metal workpieces desired for many applications.

While certain representative embodiments and details have been shown for purposes of illustrating the invention, it will be apparent to those skilled in the art that various changes in the method and apparatus 10 disclosed herein may be made without departing from the scope of the invention, which is defined in the appended claims.

We claim:

1. A method for pneumatic forming of foil workpieces comprising:

positioning a foil workpiece between a first and a second forming element, wherein said first forming element has a first resilient surface and said second forming element has at least one forming cavity;

moving said first and second forming elements into clamping relationship with said foil workpiece, wherein the first forming element contacts a first surface of the foil workpiece and the second forming element contacts a second surface of the foil workpiece;

substantially forming said foil workpiece into said forming cavity including the steps of contemporaneously:

increasing clamping pressure upon at least a first contact area of said foil workpiece in compression with said first resilient surface by applying clamping force to at least one of said first and second forming elements; and increasing pneumatic pressure between the first surface of the foil workpiece and the first forming element, such that a pneumatic force opposes said clamping force and establishes a net clamping pressure upon said first contact area, and causes deformation of said foil workpiece into said forming cavity, wherein the pneumatic pressure is increased to such an extent during the increasing of the clamping pressure that gas leaks across at least a portion of said first contact area; and removing said foil workpiece in formed condition from between said first and second forming elements.

2. The method of claim 1 wherein said step of increasing the pneumatic pressure is initiated immediately after said step of increasing clamping pressure is initiated.

3. The method of claim 1 wherein said step of increasing the pneumatic pressure is initiated a short period after said step of increasing clamping pressure is initiated.

4. The method of claim 1 wherein said steps of increasing the pneumatic pressure and increasing clamping pressure are performed at predetermined rates.

5. The method of claim 1 wherein said step of forming includes:

establishing a generally minimal net clamping pressure and a generally maximum pneumatic pressure near the completion of said forming step; and deforming final portions of said foil workpiece with generally minimal net clamping pressure and generally maximum pneumatic pressure.

6. The method of claim 1 wherein said foil workpiece has a thickness less than approximately 0.025 centimeters.

7. The method of claim 1 wherein said step of forming a foil workpiece comprises forming said workpiece into the shape of a pan.

8. The method of claim 1 wherein said step of forming a foil workpiece is performed in less than about six seconds.

9. The method of claim 1 wherein said step of forming is performed by forming said foil workpiece into multiple forming cavities.

10. The method of claim 1 wherein the step of forming said foil workpiece further includes the step of controlling net clamping pressure.

11. The method of claim 10 wherein said step of controlling the net clamping pressure is performed by varying the rate of increase in clamping pressure, while said step of increasing the pneumatic pressure is performed at a generally constant rate.

12. The method of claim 10 wherein said step of controlling the net clamping pressure is performed by varying the rate of increase in pneumatic pressure, while said step of increasing the clamping pressure is performed at a generally constant rate.

13. The method of claim 10 wherein said step of controlling the net clamping pressure is performed by varying both the rate of increase in clamping pressure and the rate of increase in pneumatic pressure.

14. The method of claim 10 wherein the step of controlling net clamping pressure further includes controlling the rate of movement of portions of said foil workpiece in said first contact area towards said forming cavity.

15. The method of claim 1 wherein:

said second forming element includes a second clamping surface bounding said forming cavity, and a retaining step defining the outer boundary of said second clamping surface, said retaining step having an edge over which said foil workpiece is bendable;

said step of positioning extends said foil workpiece generally beyond the outer boundary of said second clamping surface;

said step of increasing clamping pressure includes:

compressing portions of said first resilient surface in generally opposing relationship with said second clamping surface; and bending portions of said foil workpiece over said edge; and said step of substantially forming a foil workpiece includes reducing the net clamping pressure needed to retain said workpiece against slippage during forming by retaining said bent portions of said foil workpiece against said retaining step.

16. The method of claim 15 wherein:

said retaining step extends downward from said second clamping surface and forms a generally sharp edge therewith over which a foil workpiece is bendable; and said steps of compressing portions of said first resilient clamping surface, and bending portions of the foil workpiece are performed simultaneously.

17. The method of claim 15 wherein:

said second forming element further includes a land area adjoining the retaining step and extending outward therefrom in generally opposing relationship to portions of said first resilient clamping surface; and said step of increasing clamping pressure includes spreading said clamping force over a larger surface area including said second clamping surface and said land area;

thereby reducing increases in clamping pressure in the opposing portions of the first resilient and second clamping surfaces.

18. The method of claim 1 wherein said step of removing said foil workpiece in formed condition includes:

maintaining pneumatic pressure greater than ambient pressure between said foil workpiece and said first forming element inward from the periphery of said contact area while said workpiece remains in compression;

separating the second forming element from contact with the foil workpiece; and rapidly releasing said foil workpiece from said first resilient surface with pneumatic pressure between said foil workpiece and said first forming element.

19. The method of claim 18 wherein said step of maintaining pneumatic pressure is performed by maintaining pneumatic pressure in the range from about 1.7 bar to about 8 bar.

20. A method for pneumatic forming of foil workpieces comprising:

positioning a foil workpiece between a first and a second forming element, wherein said first forming element has a first resilient surface and said second forming element has at least one forming cavity;

moving said first and second forming elements into clamping relationship with said foil workpiece, wherein the first forming element contacts a first surface of the foil workpiece and the second forming element contacts a second surface of the foil workpiece;

substantially forming said foil workpiece into said forming cavity including the steps of contemporaneously:

increasing clamping pressure upon at least a first contact area of said foil workpiece in compression with said first resilient surface by applying clamping force to at least one of said first and second forming elements; and increasing pneumatic pressure between the first surface of the foil workpiece and the first forming element, such that a pneumatic force opposes said clamping force and establishes a net clamping pressure upon said first contact area, and causes deformation of said foil workpiece into said forming cavity, wherein completion of said forming step includes establishing a generally minimal net damping pressure;

reducing said pneumatic pressure by leaking gas across at least a portion of said first contact area; and removing said foil workpiece in formed condition from between said first and second forming elements.

21. A method for pneumatic forming of foil workpieces comprising:

positioning a foil workpiece between a first and a second forming element, wherein said first forming element has a first resilient surface and said second forming element has at least one forming cavity;

moving said first and second forming elements into clamping relationship with said foil workpiece, wherein the first forming element contacts a first surface of the foil workpiece and the second forming element contacts a second surface of the foil workpiece;

substantially forming said foil workpiece into said forming cavity including the steps of contemporaneously:

increasing clamping pressure upon at least a first contact area of said foil workpiece in compression with said first resilient surface by applying clamping force to at least one of said first and second forming elements; and increasing pneumatic pressure between the first surface of the foil workpiece and the first forming element, such that a pneumatic force opposes said clamping force and establishes a net clamping pressure upon said first contact area, and causes deformation of said foil workpiece into said forming cavity, wherein the step of forming a foil workpiece further includes:

forming an air bearing between the second surface of the foil workpiece and the forming cavity of said second forming element; and reducing friction between said foil workpiece and the forming cavity during deformation of said foil workpiece into said forming cavity; and removing said foil workpiece in formed condition from between said first and second forming elements.

22. The method of claim 21 wherein said step of forming an air bearing comprises supplying and exhausting a continuous flow of gas between the second surface of the foil workpiece and the forming cavity of said second forming element.

23. The method of claim 21 wherein said step of forming an air bearing is performed as said step of forming a foil workpiece nears completion.

* * * * *

UNITED STATES PATENT AND TRADEMARK OFFICE

CERTIFICATE OF CORRECTION

PATENT NO. : 5,649,438

DATED : July 22, 1997

INVENTOR(S) : Herbert L. Hall, Jr., Margaret M. Woodside, Stanley J. Rusek, Jr.

It is certified that error appears in the above-indentified patent and that said Letters Patent is hereby corrected as shown below:

Claim 20, line 47, "damping" should be --clamping --.

Signed and Sealed this

Eighteenth Day of November 1997

*Attest:*

*Attesting Officer*

BRUCE LEHMAN

*Commissioner of Patents and Trademarks*